US005285739A

United States Patent [19]

Huang

[11] Patent Number: 5,285,739

[45] Date of Patent: Feb. 15, 1994

[54] TRANSMISSION MECHANISM FOR A MINI-SEWING MACHINE

[76] Inventor: Dennis Huang, 2F, No. 1, Lane 9, Ningpo E Street, Taipei, Taiwan

[21] Appl. No.: 956,626

[22] Filed: Oct. 5, 1992

[51] Int. Cl.[5] ..... D05B 69/00; F16H 21/18

[52] U.S. Cl. ..... 112/221; 74/48

[58] Field of Search ..... 74/48, 49, 50; 112/169, 112/220, 221

[56] References Cited

U.S. PATENT DOCUMENTS 3,745,950 7/1973 Kato ..... 112/169

4,388,885 6/1983 Dreier ..... 112/221

5,003,898 4/1991 Huang ..... 112/220

*Primary Examiner*—Leslie A. Braun

*Assistant Examiner*—David W. Laub

*Attorney, Agent, or Firm*—Bucknam and Archer

[57] ABSTRACT

A transmission mechanism includes a transmission gear shaft having a speed reducing gear on one end driven by a DC motor via a driving gear and a transmission gear on an opposite end meshed with a driven gear on an eccentric gear shaft, which has an eccentric axle coupled to a reciprocating block via a crank and driven to reciprocate the reciprocating block causing it to alternatively move the needle arm of a mini-sewing machine up and down in performing the process of stitching.

2 Claims, 3 Drawing Sheets

TRANSMISSION MECHANISM FOR A MINI-SEWING MACHINE

BACKGROUND OF THE INVENTION

The present invention relates to a transmission mechanism for driving the needle arm of a mini-sewing machine smoothly and stably.

Various mini-sewing machines are known and widely accepted by travelers and housekeepers for the advantage of mobility. According to conventional methods, a crank shaft is commonly used and driven by a DC motor to alternatively move the needle arm up and down in performing the process of stitching. The main disadvantage of this crank shaft operated transmission mechanism is that the crank shaft vibrates when it is reciprocated, and therefore the needle may be deviated from the course.

SUMMARY OF THE INVENTION

The present invention eliminates the aforesaid disadvantage. According to the preferred embodiment of the present invention, the transmission mechanism is comprised of a DC motor, a transmission gear shaft driven by the DC motor, an eccentric gear shaft driven by the transmission gear shaft, a crank coupled to an eccentric axle on the eccentric gear shaft, and a reciprocating block driven by the crank to alternatively move the needle arm of a mini-sewing machine tip and down. Through the operation of the transmission gear shaft and the eccentric gear shaft, the reciprocating movement of the crank and the reciprocating block is smooth and stable.

DETAILED DESCRIPTION OF THE PREFERRED EMBODIMENT

Figure 1:
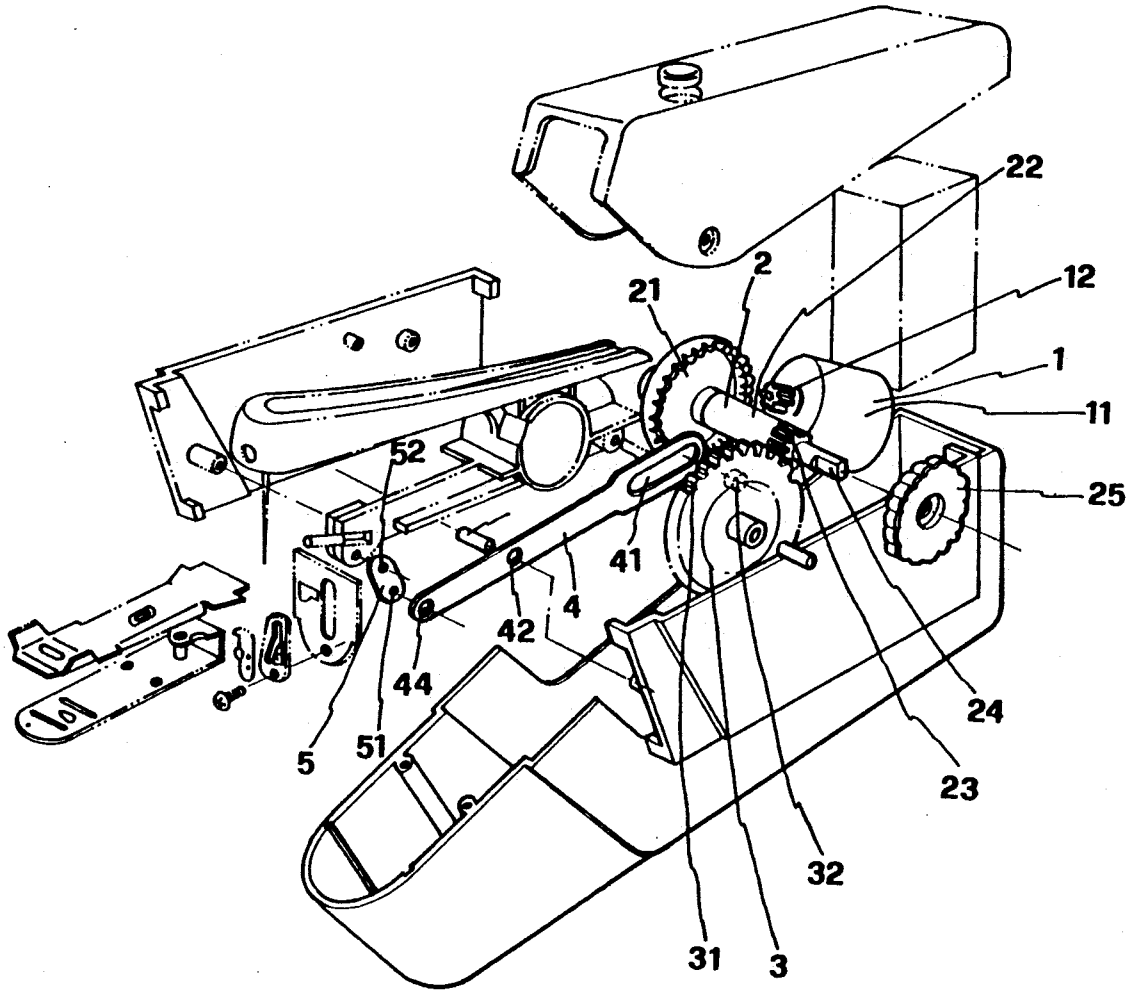
FIG. 1 is an exploded perspective view of the preferred embodiment of the transmission mechanism of the present invention.

Referring to FIG. 1, the transmission mechanism of the preferred embodiment of the present invention is generally comprised of a motor drive 1, a transmission gear shaft 2, an eccentric gear shaft 3, a crank 4, and a reciprocating block 5. The motor drive 1 is comprised of a DC motor 11 having an output shaft coupled with a driving gear 12 meshed with the transmission gear shaft 2. The transmission gear shaft 2 comprises a shaft 22 having a speed reducing gear 21 on one end meshed with the driving gear 12 of the DC motor 11, a connecting rod 24 on an opposite end coupled with a control knob 25, and a transmission gear 23 adjacent to the connecting rod 24, wherein the number of teeth of the transmission gear 23 is less than that of the speed reducing gear 21. The eccentric gear shaft 3 comprises a driven gear 31 meshed with the transmission gear 23, and an eccentric axle 32 perpendicular to the driven gear 31. In order to reduce the revolving speed, the number of teeth of the driven gear 31 is more than that of the transmission gear 23. The crank 4 is made from an elongated plate having an elongated slot 41 on one end into which the eccentric axle 32 inserts, a hole 42 on the middle through which a locating pin 43 is inserted and fastened to the casing of the sewing machine, and an eyelet hole 44 on an opposite end coupled to the reciprocating block 5. The reciprocating block 5 is made from a flat block having a hole 51 on one end coupled to the eyelet hole 44 on the crank 4, and a hole 52 on an opposite end coupled to the needle arm for permitting the needle arm to be symmetrically reciprocated.

Figure 2:
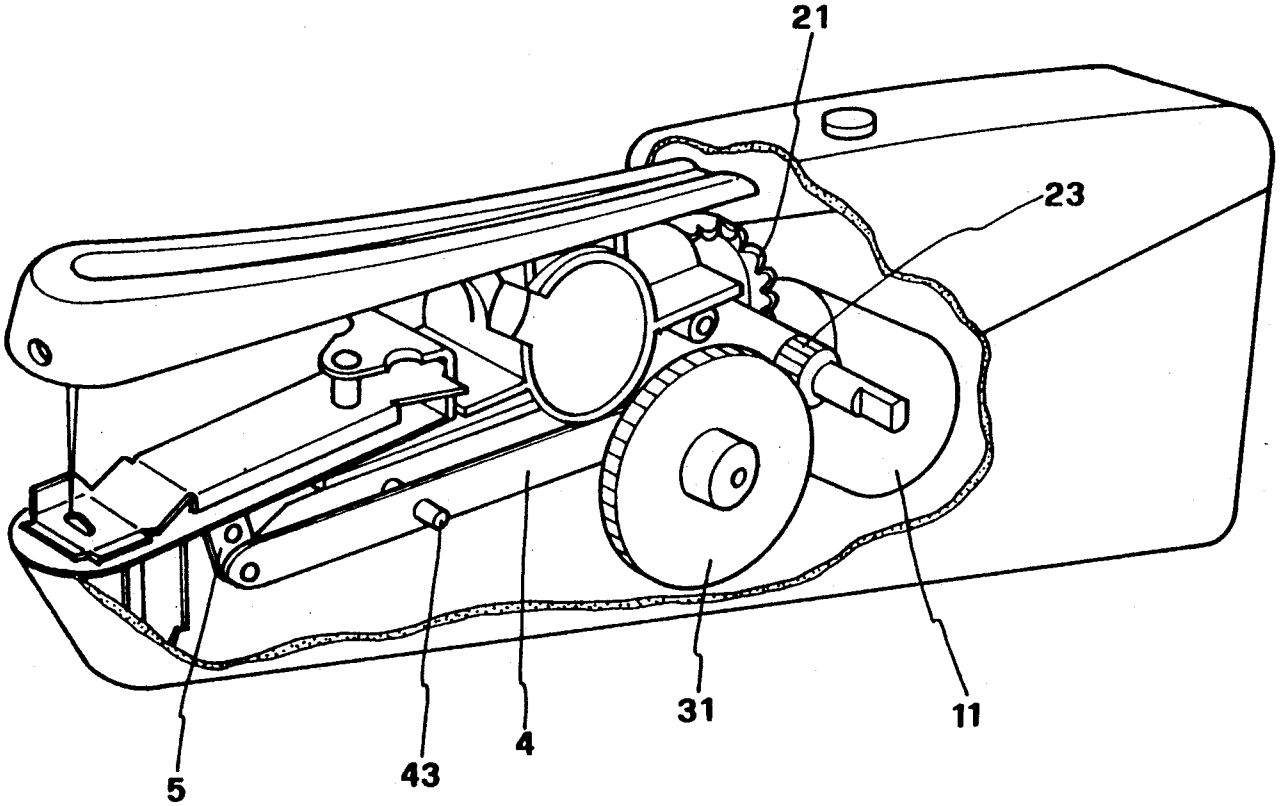
FIG. 2 is a perspective assembly view thereof.
Figure 3:
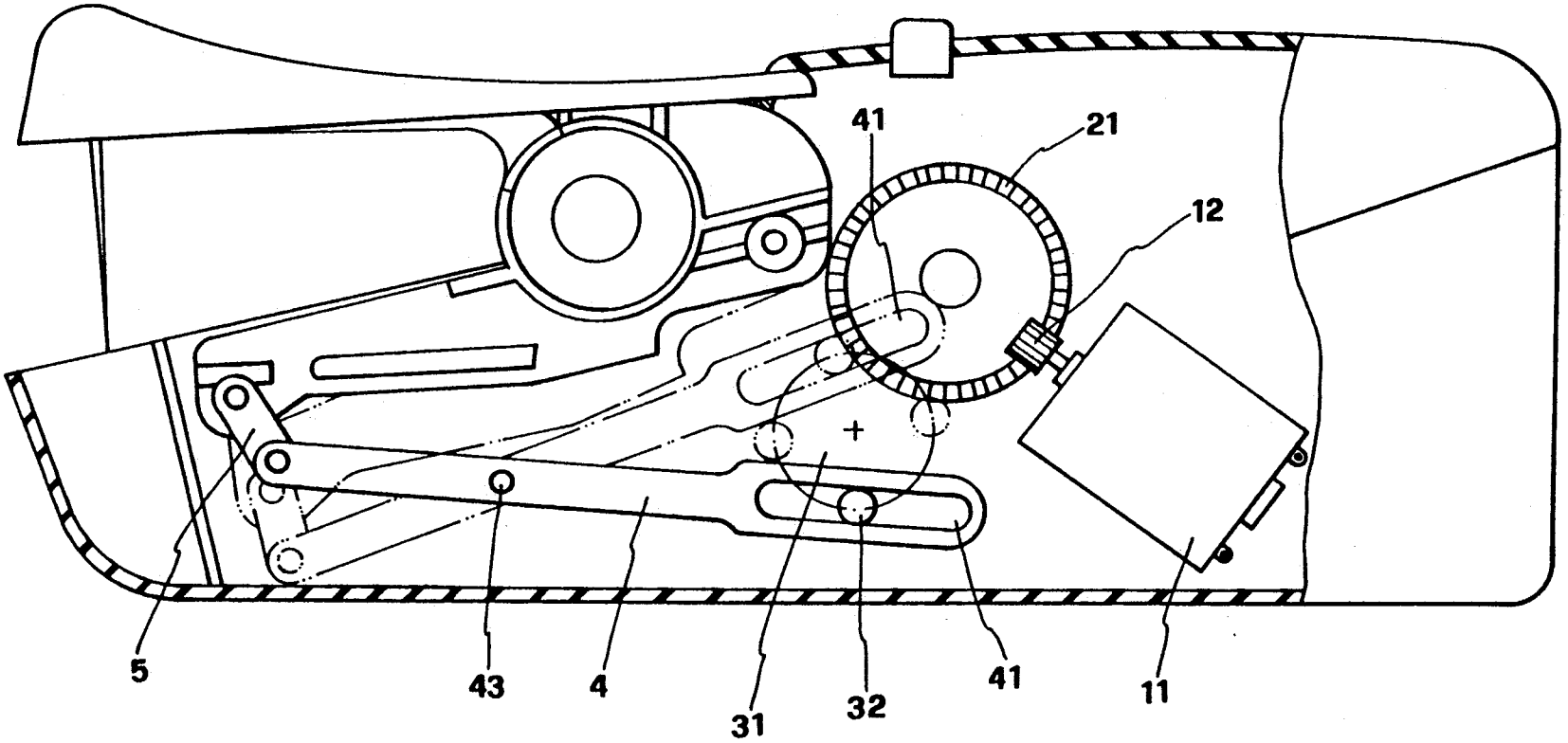
FIG. 3 is a plan view showing the operation of the transmission mechanism in reciprocating the reciprocating block thereof.

Referring to FIGS. 2 and 3, turning on the DC motor 11 causes the driving gear 12 to rotate the transmission gear 23 via the speed reducing gear 21. Rotating the transmission gear 23 causes the driven gear 31 to carry the eccentric axle 32 in reciprocating the crank 4, and therefore the reciprocating block 5 is simultaneously reciprocated to alternatively move the needle arm up and down in performing the process of stitching.

It is to be understood that the present invention is not limited to the embodiment shown by way of example and that various modifications could be made without departing from the basic teachings thereof.

What is claimed is:

1. A transmission mechanism for driving a mini-sewing machine, said transmission mechanism being housed in a casing therefor comprising:

a needle arm mounted in said casing;

a DC motor having an output shaft coupled with a driving gear;

a transmission gear shaft having a speed reducing gear on one end meshed with said driving gear on said output shaft of said DC motor, a connecting rod on an opposite end coupled with a knob, and a transmission gear adjacent to said connecting rod;

an eccentric gear shaft having a driven gear meshed with said transmission gear of said transmission gear shaft, an eccentric axle perpendicular to said driven gear;

an elongated crank having an elongated slot on one end into which said eccentric axle of said eccentric gear shaft is movably inserted, said elongated crank being pivotally mounted centrally along the length thereof to the casing of the mini-sewing machine, and an eyelet hole on an opposite end;

a reciprocating block having a hole on one end coupled to said eyelet hole on said crank and a hole on an opposite end coupled to the needle arm of the mini-sewing machine; and wherein turning on said DC motor causes said reciprocating block to be reciprocated by said crank via said transmission gear shaft and said eccentric gear shaft, to alternatively move the needle arm up and down in performing the process of stitching.

2. The transmission mechanism of claim 1 wherein the number of teeth of said speed reducing gear is more than that of said driving gear of said DC motor; the number of teeth of said driven gear is more than that of said transmission gear.

* * * * *